United States Patent [19]

Pankowiecki

[11] Patent Number: 4,593,526

[45] Date of Patent: Jun. 10, 1986

[54] STEAM TURBINE SYSTEM INSTALLATION WITH PROTECTION OF PIPING AGAINST SEISMIC LOADING

[75] Inventor: Joseph Pankowiecki, Casselberry, Fla.

[73] Assignee: Westinghouse Electric Corp., Pittsburgh, Pa.

[21] Appl. No.: 644,753

[22] Filed: Aug. 27, 1984

[51] Int. Cl.[4] ..... F01K 19/00

[52] U.S. Cl. ..... 60/657; 60/687; 248/638

[58] Field of Search ..... 60/646, 657, 687; 248/638

[56] References Cited

U.S. PATENT DOCUMENTS

| | | | |
|---|---|---|---|
| 2,359,000 | 9/1944 | Rosenzweig | 248/638 X |
| 3,794,277 | 2/1974 | Smedley et al. | 248/20 |
| 3,973,078 | 8/1976 | Wolf et al. | 174/42 |
| 4,189,927 | 2/1980 | Grag | 60/687 |
| 4,200,256 | 4/1980 | Thiel | 248/548 |

*Primary Examiner*—Stephen F. Husar
*Attorney, Agent, or Firm*—G. H. Telfer

[57] ABSTRACT

A turbine system is provided in which a turbine is associated with an auxiliary component such as a moisture separator reheater (MSR) through piping that extends over substantial distance and the respective supports for the turbine and the MSR are subject to differential movement upon a seismic shock. The turbine is rigidly supported on its foundation while the MSR has a floating support on its foundation which includes permanently lubricated sliding plates between the feet of the MSR and the MSR foundation. In addition, viscoelastic dampers are employed at spaced locations between the MSR and structural steel plates that are rigidly attached at one end to the turbine foundation. The dampers allow adequate movement of the MSR for the protection of crossover and crossunder piping due to thermal expansion and contraction, but minimize relative movement of the MSR and the turbine foundation upon seismic loading.

7 Claims, 5 Drawing Figures

STEAM TURBINE SYSTEM INSTALLATION WITH PROTECTION OF PIPING AGAINST SEISMIC LOADING

BACKGROUND AND SUMMARY OF THE INVENTION

This invention relates generally to steam turbine systems for power generation and, more particularly, to structural support arrangements for parts of the system against seismic loading.

A steam turbine system includes pieces of equipment that are connected to the steam turbine itself by piping that carries the working fluid. Moisture separator reheaters (MSRs) are utilized in nuclear steam turbine cycles or systems to reduce turbine exhaust moisture and to increase thermal efficiency. The MSRs are connected between the high and low pressure turbines and are of such large size that they are spaced a distance from the turbines and are connected to these turbines by piping systems generally referred to as crossunder pipes that communicate from the high pressure turbine to the MSR and crossover pipes from the MSR to the low pressure turbine methods. Current practice includes methods to support an MSR and its piping in relation to the turbines as needed to satisfy differential thermal expansion criteria.

The turbines themselves are rigidly anchored in a direction transverse to the shaft to rigid supporting foundation structures, such as of concrete and steel. In one form of current practice, the MSRs are also rigidly anchored to their supporting foundation structures which are generally spaced from the turbine foundation. To accommodate differential thermal expansion, the piping system is provided with sufficient flexibility features, usually in the form of expansion joints. The flexibility features are required primarily to keep the piping reactions at the turbine and MSR connections within allowable limits in addition to maintaining acceptable levels of stress in the piping itself. The arrangement is satisfactory under most conditions. Upon the occurrence of a seismic event, however, it is likely that there will be relative displacement of the MSR and turbine foundations. This means that the pipes interconnecting the MSRs and turbines will be subject to large displacements at their end points. The magnitude of these displacements is such that it is not feasible to provide the crossunder and crossover pipe systems with sufficient flexibility features to maintain acceptable reaction levels at the turbine and MSR connections as well as acceptable stresses in the piping.

In another form of current practice, the MSRs are supported on their foundation such that they are free to move in a horizontal plane in response to the thermal piping reactions from the connecting crossover and crossunder pipes. This type of arrangement is known as a "floating" MSR system which offers the advantage of minimizing the flexibility features which would otherwise have to be provided for the piping to meet differential thermal expansion loading criteria. Freedom of movement in a horizontal plane is generally provided by hanging the MSRs by means of pivoting rods from cradle supports. This type of arrangement is also deficient, however, in meeting seismic loading requirements. Since the MSRs are not rigidly connected in the horizontal plane to their supporting foundations, they will tend to remain stationary while the MSR and turbine foundations are undergoing seismic loading displacements. The crossunder and crossover pipes, connecting the MSRs to the anchored turbines which are undergoing the same displacements as the turbine foundation, will attempt to displace the MSRs along with the displacement of the turbine foundation. The MSRs will thus impose very large inertia forces on the crossunder and crossover pipe connections to the turbines that is likely to exceed allowable limits.

Therefore, it is desirable in those applications where turbine systems may be seismically loaded to have a support system which can accommodate the seismic loading as well as differential thermal expansion.

By the present invention, an arrangement is made in which the turbines are rigidly supported on their foundation and the MSRs are provided with floating supports with additional elements in the combined arrangement for protecting the piping from seismic loading effects. Functional considerations would permit the use of cradletype supports for the floating MSR system. However, for economic and space considerations, the proposed arrangement of this invention utilizes sets of permanently lubricated sliding support plates located between the MSR support feet and the MSR foundation. In addition, there are a number of viscoelastic dampers attached to the MSRs. Viscoelastic dampers are generally known and are generally characterized by having a first member rigidly attached to the supported element (i.e., the MSR) and a second member rigidly attached to a foundation (in the present case to a steel plate joined to the turbine foundation) with a dampening substance, such as bitumen, between the first and second members that permits relatively free movement in any direction in response to gradual or light forces such as would be induced by thermal expansion characteristics of the piping, but which exhibits a substantially rigid characteristic upon occurrence of a large, sharp force as would be encountered due to a seismic shock. Suitable viscoelastic dampers for use in the present invention are those of the type that have been previously used in applications such as for mounting diesel engines on shipboard in which a central cylinder is attached to the supported engine and rests within an outer cylinder attached to the foundation with a viscoelastic dampening substance located therebetween. Articles of commerce sold under the name Gerb Viscodamper Vibration Isolation Systems are suitable for this purpose.

DESCRIPTION OF THE PREFERRED EMBODIMENTS

Figure 1:
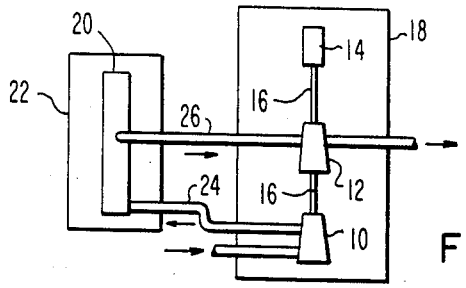
FIG. 1 is a general schematic view of a turbine system installation.

For orientation purposes, FIG. 1 shows a turbine system in general outline form. The system includes a high pressure turbine 10, a low pressure turbine 12, and an electrical generator 14 that have interconnected shafts 16 and are all supported on a turbine foundation 18. An auxiliary part of the system, namely a moisture separator reheater or MSR 20, is located on its own foundation 22 removed from the turbine foundation by a distance that may typically be about 40 feet. The illustration is simplified in showing one high pressure turbine 10, one low pressure turbine 12 and one MSR 22 while an actual installation may have more than one of such components. It serves, however, to show the general arrangement with a steam path indicated by the arrows that enters the high pressure turbine 10, such as from a steam generator, leaves the high pressure turbine through piping 24, referred to as crossunder piping, to the MSR 22, and passes through crossover piping 26 from the MSR to the low pressure turbine 12 from which it exits and may be recirculated through a steam generator.

The turbine and MSR foundations 18 and 22 are not necessarily totally isolated from each other but are, however, such that they are separate and distinct in relation to the potential effects of seismic loading. That is, they may move non-coincidentally or out of phase.

Figure 3:
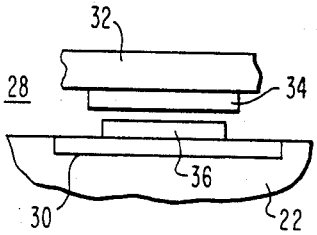
FIGS. 3 and 4 are enlarged views of parts of the system of FIG. 2.
Figure 2:
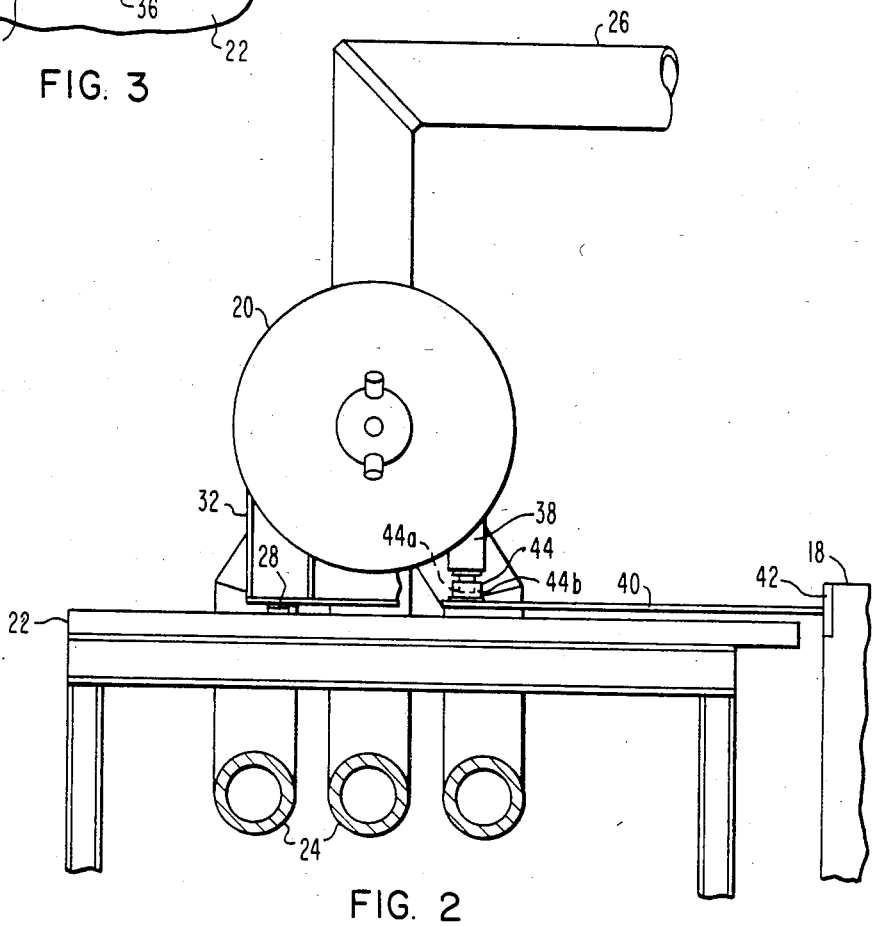
FIG. 2 is an end view of a moisture separator reheater in a turbine system with support features in accordance with an embodiment of the present invention.
Figure 5:
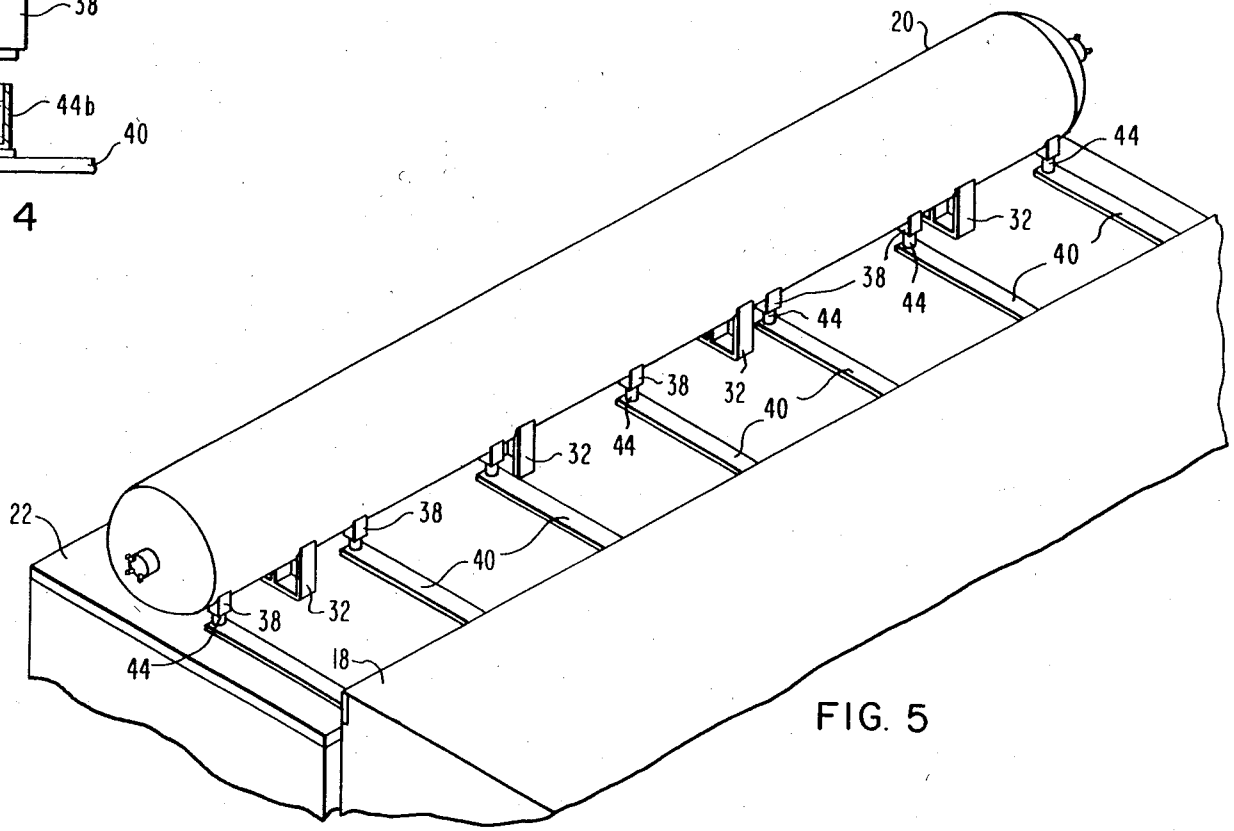
FIG. 5 is an isometric view of parts of the system of FIG. 2.

Referring to FIG. 2, major support for the MSR 20 on its foundation is provided by permanently lubricated sliding plate assemblies 28, such as are shown more clearly detail in FIG. 3, located at various spaced locations. The fixed support member 22 has a bed plate 30 permanently attached thereto and the MSR has feet 32 (also see FIG. 5) each with a plate 34 movable in relation to a plate 36 on the bed plate 30. A number of such sliding plate assemblies would be provided over the extent of the MSR which is typically about 90 feet long. Basically, the sliding plate assembly 28 gives the MSR a "floating" foundation that allows some of the thermal expansion and contraction to be taken up by the movement of the MSR 20 in relation to its foundation 22 and minimizes need for expansion joints or the like in the crossunder and crossover piping 24 and 26.

Figure 4:
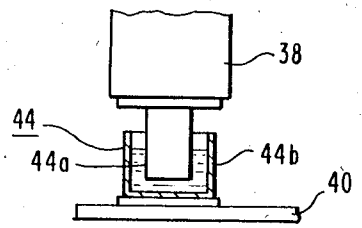

In addition, the MSR 20 is supported at various locations by feet 38. Under each of the feet 38 is a plate 40 that is permanently anchored in the turbine foundation at one end 42 but extends over to the MSR foundation 22 and is in spaced relation with it. The plate 40 could also be in sliding relation with the foundation 22. The MSR foot 38 has a relation to the structural steel plate 40 through a viscoelastic damper 44. Each damper 44 (see FIG. 4) has an inner cylinder **44*a* attached to the foot 38 and located within an outer cylinder 44*b* that is attached to the plate 40. The outer cylinder 44*b* is filled with a viscoelastic substance such as bitumen. The dampers 44 and sliding plate assemblies 28 allow minor movements of the MSR that occur through thermal expansion and contraction of the piping 24 and 26. Any major forces resulting from seismic loading are resisted, however, by the dampers 44**. That is, the viscoelastic dampers are means for permitting slow displacements in all directions while resisting sudden load application.

Thus, it is seen that the differential thermal expansion of the crossunder and crossover piping 24 and 26 is accommodated by the floating support features of the MSR 20, minimizing the flexibility features required for the piping. Since the piping thermal expansion is a slow acting process, the viscoelastic dampers 44 exert negligible restraint, permitting the MSR piping to attain a thermal equilibrium position. During seismic loading, which is characterized by sudden load application, the viscoelastic dampers 44 behave essentially as rigid members. Any horizontal seismic displacement of the turbine foundation 18 is transferred through the structural members 40 to the MSR 20 such that the crossunder and crossover pipes 24 and 26 see no net end point displacement or external seismic forces.

Although the presently proposed system does not prevent relative vertical seismic displacement between the MSRs and the turbine foundation 18, this does not affect the usefulness of the invention. Because the MSR and turbine foundations 20 and 18 are much stiffer in the vertical direction than the horizontal direction, the seismic differential vertical displacements are small enough that they can be absorbed by the flexibility features provided in the crossunder and crossover piping 24 and 26.

The invention thus provides a method for effectively protecting crossunder and crossover piping systems from the effects of seismic loading. In doing so, it prevents damage to the equipment and avoids hazard to personnel.

While the invention has been shown and described in a few forms only, it will be apparent that various changes and modifications may be made consistent with the general principles thereof.

What is claimed is:

1. A steam turbine system installation with protection against seismic loading for piping between parts of the system comprising:

at least one steam turbine rigidly mounted on a substantially fixed turbine foundation;

an auxiliary part of the turbine system mounted by a selectively yielding mounting system on a substantially fixed auxiliary foundation spaced from said turbine foundation;

piping connected between said steam turbine and said auxiliary part for fluid flow therebetween;

said mounting system for said auxiliary part comprising means for allowing horizontal movement of said auxiliary part in relation to said auxiliary foundation in response to thermal expansion and contraction of said piping and means for resisting movement of said auxiliary part in relation to said auxiliary foundation due to seismic loading.

2. An installation in accordance with claim 1 wherein;

said at least one steam turbine includes a high pressure turbine and a low pressure turbine;

said auxiliary part of said turbine system is a moisture separator reheater; and, said piping comprises crossunder piping for carrying steam from said high pressure turbine to said moisture separator reheater and crossover piping for carrying steam from said moisture separator reheater to said low pressure turbine.

3. An installation in accordance with claim 1 wherein;

said means for allowing horizontal movement of said auxiliary part in relation to said auxiliary foundation comprises a plurality of sliding plate assemblies.

4. An installation in accordance with claim 1 wherein:

said means for resisting movement of said auxiliary part in relation to said auxiliary foundation due to seismic loading comprises a plurality of viscoelastic dampers.

5. An installation in accordance with claim 4 wherein:

said viscoelastic dampers each comprise a first member in fixed relation to said auxiliary part and a second member in fixed relation to a support plate having an end remote from said auxiliary part that is in fixed relation to said turbine foundation.

6. A steam turbine system installation with protection of piping against seismic loading comprising:

a turbine foundation;

a high pressure turbine and a low pressure turbine rigidly mounted on said turbine foundation;

a moisture separator reheater (MSR) foundation;

an MSR on said MSR foundation;

crossunder piping for steam from said high pressure turbine to said MSR;

crossover piping for steam from said MSR to said low pressure turbine;

a plurality of sliding plate assemblies between said MSR and said MSR foundation allowing horizontal relative movement;

one or more support plates having an extremity anchored to said turbine foundation and having a portion extending horizontally proximate to said MSR;

a plurality of viscoelastic dampers attached between said MSR and said one or more support plates.

7. An installation in accordance with claim 6 wherein:

said portion of said one or more support plates is related to said MSR foundation without fixed attachment.

* * * * *